US007641502B2

(12) United States Patent
Itou et al.

(10) Patent No.: US 7,641,502 B2
(45) Date of Patent: Jan. 5, 2010

(54) CONNECTOR DEVICE

(75) Inventors: Tomonari Itou, Yokkaichi (JP); Takao Hata, Yokkaichi (JP); Satoshi Morikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/127,288

(22) Filed: May 27, 2008

(65) Prior Publication Data

US 2008/0299816 A1 Dec. 4, 2008

(30) Foreign Application Priority Data

May 31, 2007 (JP) ..... 2007-145116

(51) Int. Cl.
*H01R 13/648* (2006.01)

(52) U.S. Cl. ..... 439/383

(58) Field of Classification Search ..... 439/350, 439/358, 383–385, 587
See application file for complete search history.

(56) References Cited

U.S. PATENT DOCUMENTS 3,137,535 A * 6/1964 Collier et al. ..... 439/350
6,419,400 B1 * 7/2002 Wiltjer et al. ..... 385/55
6,443,764 B2 * 9/2002 Makita ..... 439/587
7,104,831 B2 * 9/2006 Fukatsu et al. ..... 439/385
7,114,983 B2 * 10/2006 Fukatsu et al. ..... 439/358
7,311,546 B2 * 12/2007 Itou ..... 439/385
7,458,838 B2 * 12/2008 Itou ..... 439/281
7,553,186 B2 * 6/2009 Morikawa et al. ..... 439/587

* cited by examiner

*Primary Examiner*—Renee Luebke
*Assistant Examiner*—Larisa Tsukerman
(74) *Attorney, Agent, or Firm*—Gerald E. Hespos; Anthony J. Casella

(57) ABSTRACT

Front shake preventing ribs (37) are provided at positions spread over the entire inner periphery of a front end of an inner housing (23) and contact a receptacle (14) of a male housing (10) to prevent shaking between an inner housing (23) and a receptacle (14). A wall (31) faces an opening edge portion of the receptacle (14) at a rear end of the inner housing (23) with respect to the connecting direction with the male connector (10). The receptacle (14) is formed with an annular rib (18) projecting in a connecting direction the connectors (10, 20) at a position to surround the inner housing (23) over the entire periphery. The wall (31) has an annular groove (32) that engages the annular rib (18) to prevent shaking between the connectors (10, 20).

19 Claims, 8 Drawing Sheets

CONNECTOR DEVICE

BACKGROUND OF THE INVENTION

1. Field of the Invention

The invention relates to a pair of connectors connectable with each other.

2. Description of the Related Art

U.S. Pat. No. 7,311,546 discloses male and female connectors that are connectable with each other. The male connector has a receptacle that opens forward, and male terminals project into the receptacle.

The female connector has a female housing that can fit into the receptacle. Female terminals are mounted in the female housing and connect with the male terminals when the female housing is fit into the receptacle. A tube surrounds the outer peripheral surface of the female housing and can fit on the receptacle of the male connector. The tube is formed with a lock arm that can be engaged with a lock of the male connector to lock the two connectors in a properly connected state.

A retaining cap is mounted on the front of the female housing, and first shake preventing portions project from the outer peripheral surface of the retaining cap. Further, second shake preventing portions are provided at the back end of the inner peripheral surface of the tube.

The first shake preventing portions closely contact the inner peripheral surface of the receptacle and the second shake preventing portions closely contact the outer peripheral surface of the receptacle when the connectors reach the properly connected state to prevent shaking of the two connectors. The prevention of shaking of the connectors before and after contact parts of the male and female terminals is intended to prevent the terminals from abrading against each other. Such abrasion could cause gold plating to be peeled off the contact parts and could increase electrical resistance or cause other damage to the terminals.

The above-described construction cannot provide shake prevention on the cut part of the tube where the lock arm is provided. Thus, the second shake preventing portions necessarily are arranged in a nonuniform manner, thereby limiting efforts to improve shake prevention between the connectors.

The invention was developed in view of the above situation and an object thereof is to provide a connector device capable of improving a function of restricting shaking between connectors.

SUMMARY OF THE INVENTION

The invention relates to a connector assembly comprising first and second connectors that are connectable with each other. The first connector includes a receptacle that is open in a connecting direction with the second connector and a first terminal projects into the receptacle. The second connector has a housing configured to fit into the receptacle and includes a second terminal connectable with the first terminal. At least one front shake preventing rib is provided near a front end of the housing with respect to a connecting direction with the second connector. The front shake preventing rib at least partly surrounds the housing and contacts the housing or the receptacle when the connectors reach a properly connected state for preventing shaking between the connectors. At least one wall is provided near a rear end of the housing with respect to the connecting direction with the first connector and is arranged to face an opening edge of the receptacle. One of the opening edge of the receptacle and the wall includes at least one rear shake preventing rib projecting substantially in the connecting direction of the connectors at a position to surround at least part of the housing. The other of the opening edge of the receptacle and the wall includes at least one groove that engages the rear shake preventing rib when the connectors reach a properly connected state for preventing shaking between the connectors.

Accordingly, shaking between the properly connected connectors is prevented at positions surrounding the housing over substantially the entire periphery at both front and rear ends of the housing. Thus, shake prevention between the connectors is improved as compared with the case, for example, where shake prevention is provided at a position biased in the peripheral direction of the housing at one of the front and rear ends of the housing.

The front shake preventing rib may be formed integrally or unitarily on the outer surface of the housing. Thus, shaking of the housing is prevented without a separate member and abrasion of the terminal is prevented.

The second connector may include an outer housing separate from the housing and adapted to cover the housing. The outer housing may include at least one locking mechanism for locking the first connector in the connecting direction when the connectors reach the substantially properly connected state.

The outer housing and the housing may be slidably displaceable relative to each other in the connecting direction of the connectors, and at least one resilient member may be mounted between the outer housing and the housing. The resilient member is pressed by the outer housing and the housing when the connectors reach the properly connected state and resiliently contracts in the connecting direction of the connectors.

Thus, the resilient force of the resilient member biases the housing forward in the connecting direction when the connectors reach the properly connected state to prevent shaking between the connectors in forward and backward directions. Further, the outer housing is pressed backward in the connecting direction to prevent the shaking of the locking mechanism in forward and backward directions.

The resilient member may be made of rubber, and hence expands upon being pressed between the housing and the outer housing. Accordingly contact pressures acting on the housing and the outer housing are distributed to become smaller, eliminating the need for a measure against creep caused by the contact pressures.

The resilient member, the housing portion and the outer housing may include positioning portions in the form of one or more projections and one or more recesses engageable with each other. Thus, the resilient member is not displaced when pressed between the outer housing and the housing, and resilient forces on the housing and the outer housing are predictable.

The positioning portions may include positioning projections formed on the resilient member and positioning recesses formed in the housing and the outer housing.

The rear shake preventing rib and the groove may be ring-shaped to surround the housing over substantially the entire periphery.

The rear shake preventing rib may be formed at or near the opening edge of the receptacle, and the groove may be formed in the wall.

The groove or the rear shake preventing rib may include a projection to be pressed between the groove and the rear shake preventing rib when the connectors reach the properly connected state. Thus, the groove and the rear shake preventing rib are fixed firmly.

The projection may be arranged at a position to surround the housing over the entire periphery.

At least one seal ring may be mounted between the receptacle and the housing near an opening end of the receptacle. The seal ring is pressed by the receptacle and the housing to provide sealing therebetween. Accordingly, the rear shake preventing rib is pressed out by the resilient force of the seal ring and is pressed against the peripheral surface of the groove so that the groove and the rear shake preventing rib are fixed firmly.

At least one outer shake preventing rib may be provided on the inner peripheral surface of the outer housing or the outer peripheral surface of the receptacle. The outer shake preventing rib contacts the inner peripheral surface of the outer housing or the outer peripheral surface of the receptacle when the connectors reach the properly connected state for preventing the shaking between the connectors.

At least one projection may project in on part of the inner peripheral surface of the receptacle for contacting the front shake preventing rib.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
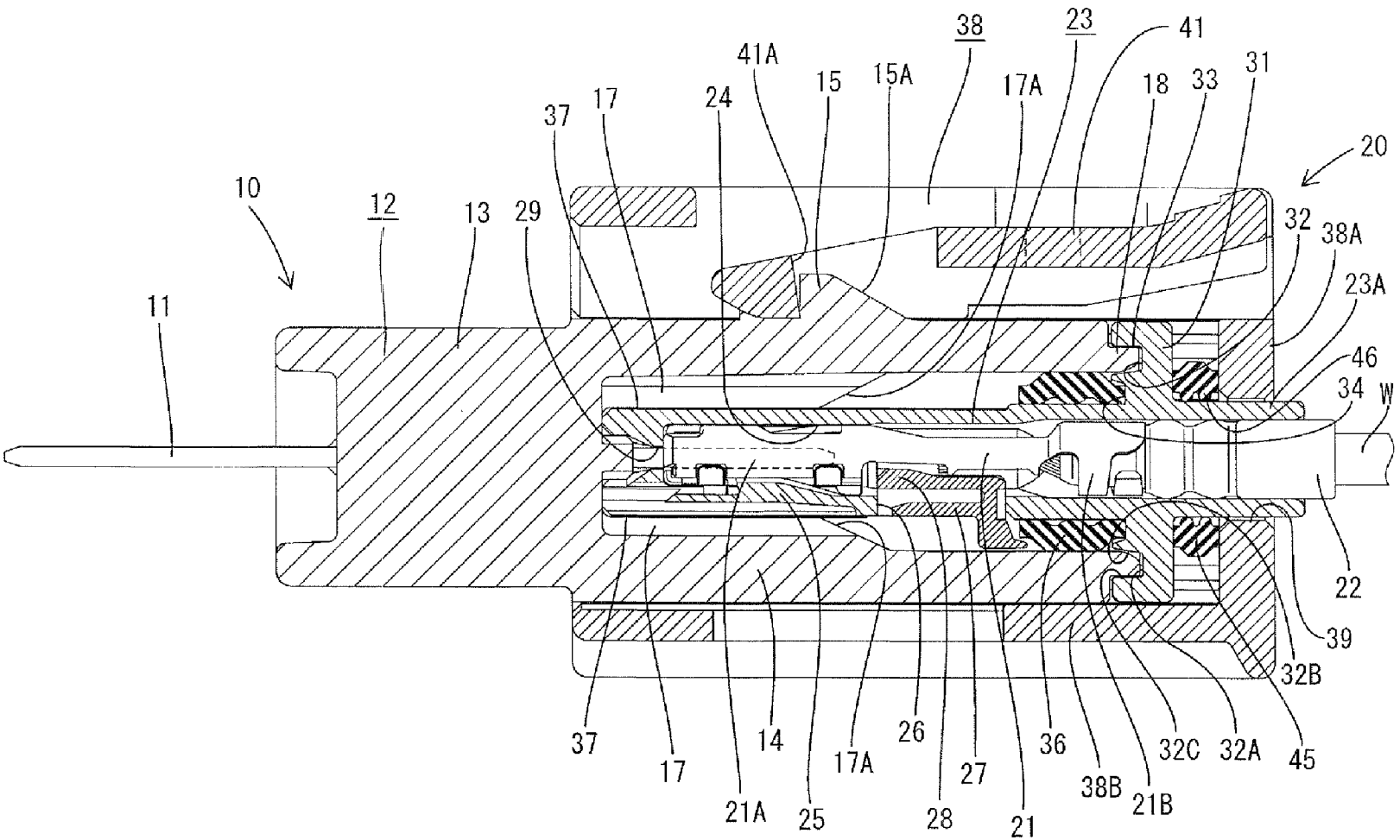
FIG. 1 is a side view in section of a connector device according to a first embodiment.

A connector assembly in accordance with a first embodiment of the invention is described with reference to FIGS. 1 to 4. The connector assembly has a male connector 10 and a female connector 20 that are connectable with each other.

In the following description, in the respective constituent members, ends of the connectors 10, 20 to be connected are referred to as the front ends and reference is made to FIG. 1 concerning upper and lower sides.

The male connector 10 has two male terminals 11 that are long in forward and backward directions, and a male housing 12 that is made e.g. of synthetic resin. A terminal holding portion 13 penetrates the male housing 12 in forward and backward directions and is configured for holding the male terminals 11. A wide tubular receptacle 14 projects forward from the outer periphery of the terminal holding portion 13 and surrounds parts of the male terminals 11 that project forward from the terminal holding portion 13.

A lock 15 projects from the top surface of the receptacle 14 at an intermediate position with respect to forward and backward directions and width directions. A riding surface 15A is formed the front of the lock projection 15 and inclines to reduce a projecting distance gradually towards the front.

Figure 2:
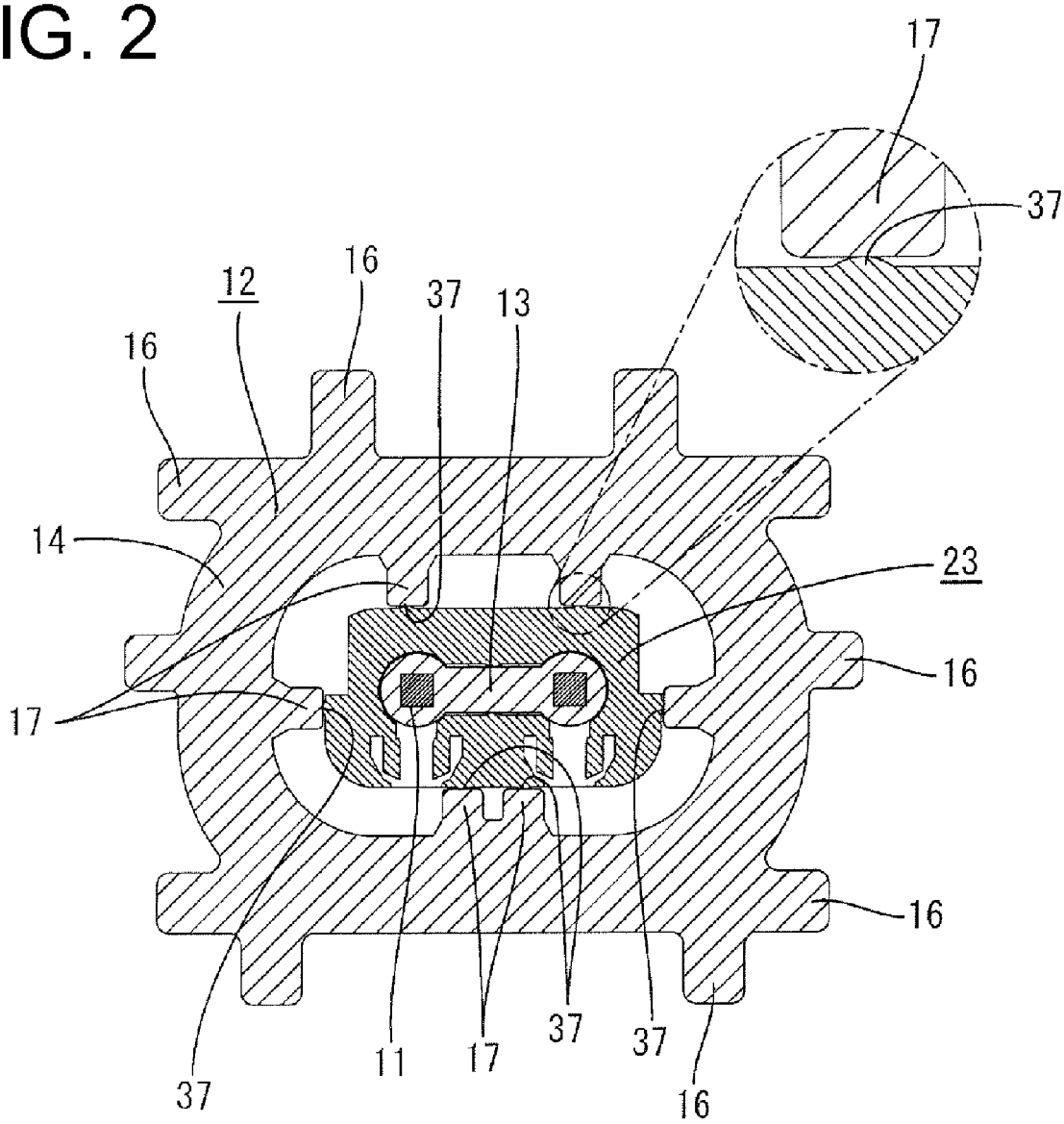
FIGS. 2 and 2*a* are sections showing an engaged state of a back end portion of the receptacle and a front end portion of an inner housing.

As shown in FIG. 2, guide ribs 16 extend in forward and backward directions at ten positions on the outer peripheral surface of the receptacle 14. More particularly, the guide ribs 16 are arranged at the opposite sides of the lock 15 on the top surface of the receptacle 14; at each of the upper, lower and intermediate positions of the opposite side surfaces; and at opposite widthwise ends of the bottom surface.

Six projections 17 extend in from the back side of the inner peripheral surface of the receptacle 14. As shown in FIG. 1, the respective projections 17 are narrow and long in forward and backward directions and extend in a part of the receptacle 14 from an intermediate position in forward and backward directions to the rear end of the receptacle 14, i.e. in a part of the receptacle 14 where the male terminals 11 are arranged. A dimension of the projections 17 in forward and backward directions is slightly longer than the length of the male terminals 11 projecting into the receptacle 14. A guiding surface 17A is formed at the front of each projection 17 and is inclined to reduce a projecting distance of the projection 17 gradually towards the front. As shown in FIG. 2, the six projections 17 are arranged so that two are near the widthwise ends of the upper side of the inner peripheral surface of the receptacle 14, two are at vertical intermediate positions of the opposite sides, and two are in the widthwise intermediate position of the lower side.

An annular rib 18 is provided near the open front end of the receptacle 14. The annular rib 18 projects forward along the inner peripheral surface of the receptacle 14 and is formed by thinning the outer periphery of the receptacle 14. The thickness of the annular rib 18 in inward and outward directions is substantially half the thickness of the receptacle 14.

The female connector 20 includes female terminals 21 that are long in forward and backward directions. A substantially box-shaped connecting portion 21A is formed at the front end of each female terminal 21 and is connectable with the male terminal 11. A wire connection barrel 21B is formed at the rear end and is crimped, bent or folded into connection with an end of a wire W and with a resilient rubber plug 22 mounted on the wire W. The resilient plug 22 is held in close contact with the inner circumferential surface of a terminal accommodating chamber 24 to provide sealing.

The female connector 20 includes an inner housing 23 made e.g. of synthetic resin and configured for accommodating the female terminals 21. The inner housing 23 is in the form of a block that is long in forward and backward directions and is fittable into the receptacle 14 of the male housing 12.

Two terminal accommodating chambers 24 are formed substantially side by side in the inner housing 23 and are capable of accommodating the female terminals 21 inserted from behind. The rear end of the inner housing 23 has cylindrical terminal inserting portions 23A arranged side by side and communicating with the respective terminal accommodating chambers 24.

A locking lance 25 is cantilevered forward from the lateral bottom wall of each terminal accommodating chamber 24 of the inner housing 23. The locking lances 25 are deformable up and down. Parts of the inner housing 23 before the locking lances 25 open forward.

A retainer mounting portion 26 is provided at a position behind the center of the inner housing 23 in forward and backward directions. The retainer mounting portion 26 communicates with the terminal accommodating chambers 24 and opens in the bottom surface of the inner housing 23.

A side-type retainer 27 made e.g. of synthetic resin can be mounted into the retainer mounting portion 26. The retainer 27 includes locks 28 for engaging the connecting portions 21A of the female terminals 21 from behind to retain the female terminals 21 in the terminal accommodating chambers 24.

Insertion openings 29 penetrate the front wall of the inner housing 23 substantially in forward and backward directions at positions corresponding to the terminal accommodating chambers 24. Thus, the male terminals 11 can be inserted through these insertion openings 29 from the front to be guided into the terminal accommodating chambers 24.

A wall 31 projects out from the entire outer periphery of the inner housing 23 at a rear end of the inner housing 23 before the terminal inserting portions 23A and is aligned orthogonal to a connecting direction of the two connectors 10, 20. The outer shape of the wall 31 corresponds to the outer shape of the receptacle 14. Thus, the outer peripheral surface of the receptacle 14 and the projecting end surface of the wall 31 are substantially flush with each other in forward and backward direction when the wall 31 and the receptacle 14 are substantially opposed to each other. The terminal inserting portions 23A project back from the wall 31.

Figure 3:
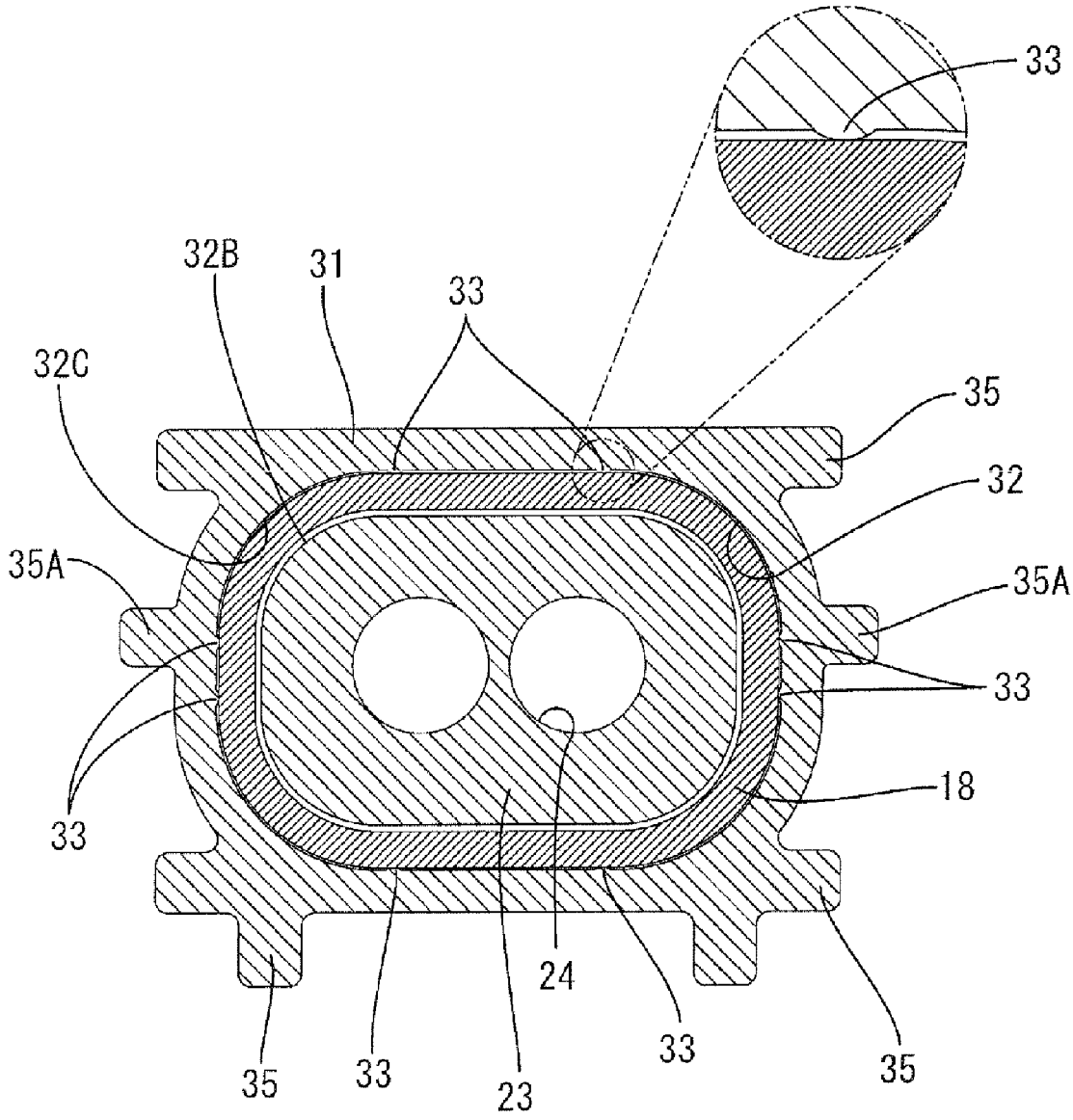
FIG. 3 is a section showing an engaged state of an annular rib and an annular groove.

An annular groove 32 is formed in the front surface of the wall 31 for receiving the annular rib 18. As shown in FIG. 3, the annular groove 32 has a wide ring shape and extends around the entire periphery of the inner housing 23. A bottom surface 32A of the groove 32 is aligned substantially at right angles to the connecting direction of the two connectors 10, 20. Inner and outer surfaces 32B and 32C extend substantially parallel to the connecting direction along the inner and outer extremes of the bottom surfaces 32A.

The annular groove 32 is formed at a position retracted inwardly by a constant distance from the projecting end surface of the wall 31, i.e. the projecting end surface of the wall portion 31 and the outer surface 32C of the annular groove 32 are substantially parallel. Additionally, the width of the annular groove 32 is set to a specified dimension.

Eight projections 33 are provided on the outer surface 32C of the annular groove 32 so that two projections 33 are provided on each of the upper, lower, left and right sides of the annular groove 32. Accordingly, the projections 33 are distributed over substantially the entire periphery of the inner housing 23.

Eight guide projections 35 are formed on the projecting end surface of the wall 31 so that guide projections 35 are provided at three spaced apart positions on each of the opposite sides and at two spaced apart positions on the bottom. The guide projections 35 are provided at positions (see FIGS. 3 and 4) corresponding to the guide ribs 16 of the receptacle 14. The top of the projecting end surface of the wall 31 is a substantially flat surface. The two projections 35A provided at the middle of the opposite sides of the outer end surface are engageable with engageable portions 43 of an outer housing 38 to be described later.

The rear surface of the wall 31 is substantially flat and substantially perpendicular to the outer peripheral surface of the inner housing 23.

An annular recess 34 is formed at the base of the front surface of the wall 31 and is substantially continuous with the inner housing 23 (see FIG. 1). The annular recess 34 is ring-shaped and is between the inner wall defining the annular groove 32 and the outer circumferential surface of the inner housing 23. The annular recess 34 is not as deep as the annular groove 32.

A seal ring 36 is mounted on the outer peripheral surface of the inner housing 23 at a position before the wall 31. The seal ring 36 is shaped so that an intermediate part thereof in forward and backward directions bulges radially outward, and the front and rear ends thereof are thinned. The seal ring 36 is mounted on the inner housing 23 with the rear end thereof fit into the annular recess 34 and the bulging part projects before the annular groove 32.

Figure 2A:
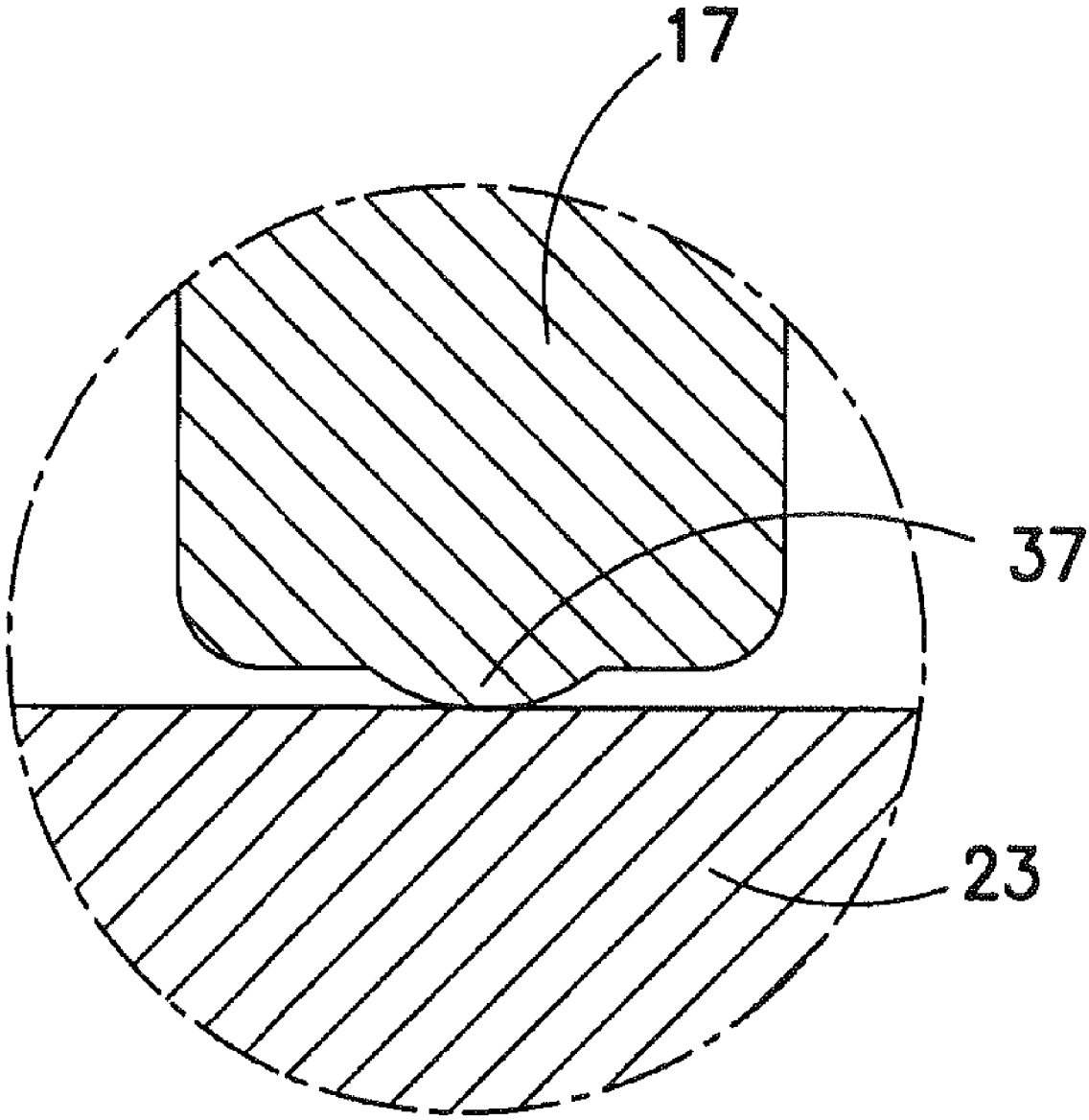

Six front shake preventing ribs 37 project unitarily out from the outer peripheral surface of the front part of the inner housing 23 and are long in forward and backward directions. The front shake preventing ribs 37 are at positions corresponding to the projections 17 of the male housing 12, as shown in FIG. 2. More specifically, the front shake preventing ribs 37 are arranged so that two are at positions near the opposite sides of the top surface of the inner housing 23, one is at an intermediate position of each of the opposite side surfaces, and two are at positions near the widthwise center of the bottom surface between the locking lances 25. Thus, the front shake preventing ribs 37 are distributed over substantially the entire periphery of the inner housing 23. A structurally and functionally similar variation of the receptacle and inner housing is illustrated in FIG. 2*a*. More particularly, FIG. 2*a* shows an optional arrangement where shake preventing ribs 37 are formed on the respective projections 17 and project inwardly for contacting the inner housing 23.

The front shake preventing ribs 37 arranged on the top surface of the inner housing 23 extend from the front end of the inner housing 23 to positions immediately before the seal ring 36, and the front shake preventing ribs 37 formed on the other surfaces extend to positions immediately before the retainer mounting portion 26.

The outer housing 38 of the female connector 20 partly covers the inner housing 23. The outer housing 38 is formed separate from the inner housing 23 and is assembled with the inner housing 23 to be displaceable in forward and backward directions. The outer housing 38 is made e.g. of synthetic resin and includes a back wall 38A with an outer shape slightly larger than the wall 31. An outer tube 38B projects forward from the peripheral edge of the back wall 38A and is capable of surrounding the wall 31. A space is defined between the outer tube portion 38B and the inner housing 23 for receiving the receptacle 14 of the male connector 10. Loose insertion holes 39 penetrate the back wall 38A in forward and backward directions and can loosely receive the terminal inserting portions 23A of the inner housing 23. The front surface of the back wall 38A is a substantially flat surface substantially parallel to the rear surface of the wall 31.

The outer housing 38 includes a lock arm 41 for engaging the lock 15 of the male connector 10 to lock the two connectors 10, 20 in a properly connected state. The lock arm 41 is cantilevered forward from the upper wall of the outer tube 38B so that the front end is free and resiliently displaceable up and down. An engaging hole 41A is formed near the front end of the lock arm 41 and is engageable with the lock 15.

Figure 4:
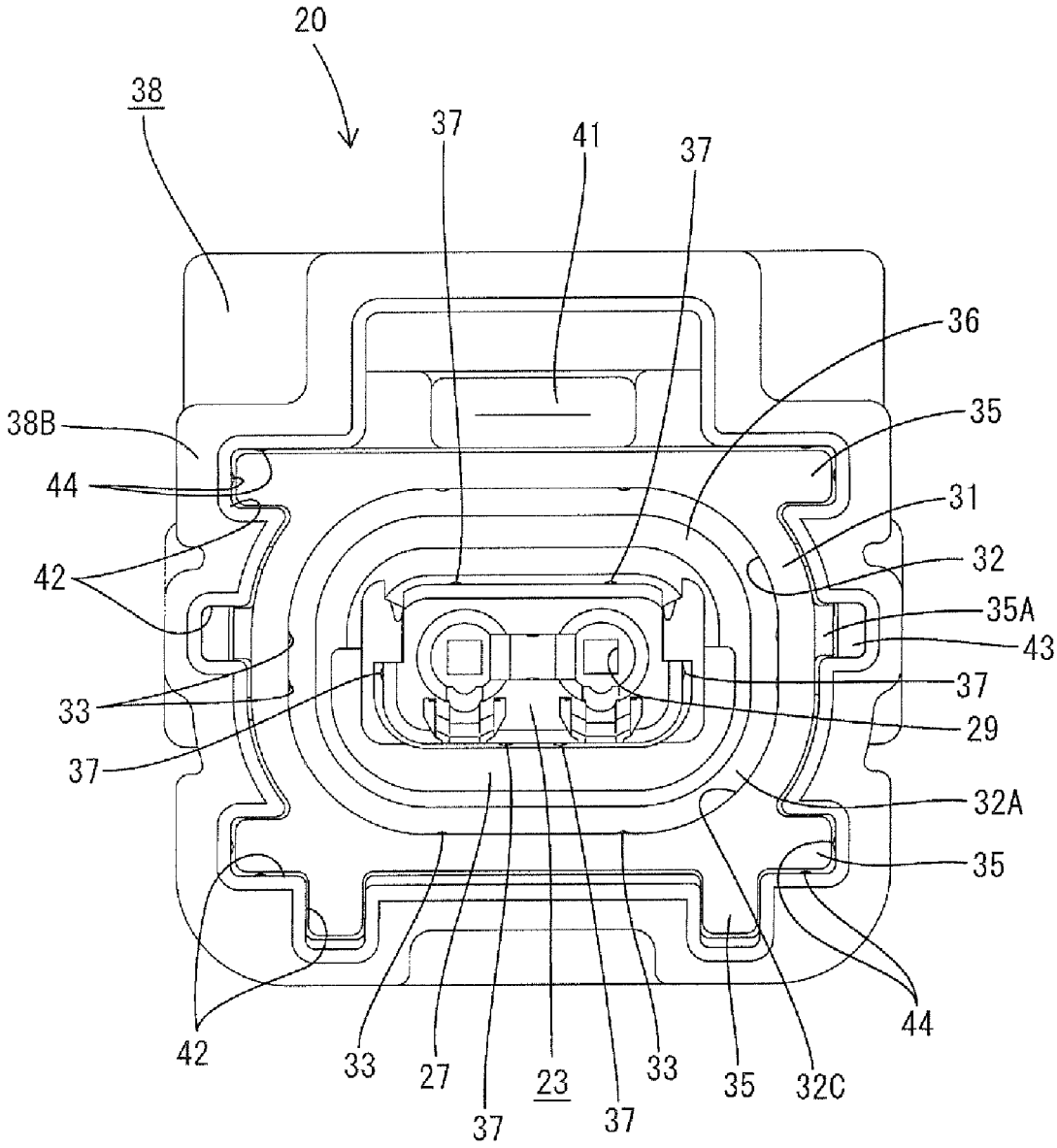
FIG. 4 is a front view of a female connector.

The outer tube 38B is formed with guide grooves 42 at positions corresponding to the respective guide ribs 16 and guide projections 35, as shown in FIG. 4. Thus, the guide grooves 42 can receive the respective guide ribs 16 of the receptacle 14 and the respective guide projections 35 of the wall 31 in forward and backward directions. Movement of the guide ribs 16 and the guide projections 35 in forward and backward directions is guided by the guide grooves 42. The inner housing 23 is assembled with the outer housing 38 and slid in forward and backward directions with the guide projections 35 of the wall 31 fit in the guide grooves 42.

The guide grooves 42 corresponding to the guide projections 35A of the wall 31 are formed with the engageable portions 43. The guide projections 35A are engaged with the engageable portions 43 to prevent the inner housing 23 from being separated forward from the outer housing 38. It should be noted that the inner housing 23 can slide in forward and backward directions in a range where the guide projections 35A move forward and backward behind the engageable portions 43.

Two outer shake preventing ribs 44 are provided in each of the guide grooves 42 at the upper and lower positions of the opposite side surfaces of the outer tube 38B. More specifically, the outer shake preventing ribs 44 are provided on the side and upper surfaces of each upper guide groove 42 and are provided on the side and lower surfaces of each lower guide groove 42.

A resilient member 45 is mounted between the back wall 38A of the outer housing 38 and the wall 31 of the inner housing 23 (see FIG. 1). The resilient member 45 preferably is made of rubber and is in the form of a wide tube fittable on the terminal inserting portions 23A. An intermediate part of the resilient member 45 in forward and backward directions bulges radially out, and lips 46 are formed on the inner circumferential surface thereof.

The two connectors 10, 20 are positioned opposed to each other and are brought closer together. As a result, the front end of the inner housing 23 is inserted into the receptacle 14 and the receptacle 14 is inserted between the inner housing 23 and the outer tube 38B of the outer housing 38. At this time, the guide ribs 16 of the receptacle 14 enter the guide grooves 42 of the outer tube 38B and are guided to squeeze the outer shake preventing ribs 44 of the guide grooves 42. Further, the front end of the inner housing 23 contacts the guiding surfaces 17A of the projections 17 at the back of the receptacle 14 to have its posture corrected and is inserted smoothly into a space inside the projections 17. At this time, the front shake preventing ribs 37 of the inner housing 23 are pressed by the projecting ends of the projections 17. The male terminals 11 are inserted through the insertion openings 29 of the inner housing 23 to enter the connecting portions 21A of the female terminals 21.

The two connectors 10, 20 are pressed further towards each other so that the leading end of the receptacle 14 reaches the outer side of the seal ring 36 and the receptacle 14 moves farther towards the back side while squeezing the seal ring 36 inwardly. The annular rib 18 of the receptacle 14 is inserted into the annular groove 32 of the wall 31 and is pressed out by the resilient restoring force of the seal ring 36. Thus, the annular rib 18 is accommodated in the annular groove 32 while pressing the projections 33.

The two connectors 10, 20 are pressed still further towards each other. Thus, the leading end of the receptacle 14 presses the wall 31 and the resilient member 45 arranged between the wall 31 and the back wall 38A resiliently contracts. The outer housing 38 moves forward relative to the inner housing 23, and the terminal inserting portions 23A gradually project back from the back wall 38A through the loose insertion holes 39. Further, the leading end of the lock arm 41 moves onto the riding surface 15A of the lock 15 to deform the lock arm 41 up.

The leading end of the lock arm 41 moves over the lock 15 when the connectors 10, 20 reach the properly connected state. As a result, the lock arm 41 resiliently restores and the lock 15 enters the engaging hole 41A. In this way, the lock arm 41 and the lock 15 are engaged from the front and behind to lock the connectors 10, 20 in their properly connected state. At this time, the resilient member 45 is squeezed between the wall 31 and the back wall 38A. Further, the seal ring 36 is squeezed resiliently between the receptacle 14 and the inner housing 23, thereby hermetically holding the space between the receptacle 14 and the inner housing 23. The resilient force of the seal ring 36 presses the annular rib 18 against the outer surface 32C of the annular groove 32 and engages the projections 33 on the outer surface 32C. Thus, the annular rib 18 and the annular groove 32 are fixed strongly over substantially the entire periphery. This engagement of the annular rib 18 and the annular groove 32 over substantially the entire periphery at the rear end of the inner housing 23 prevents radial movements of the wall 31 relative to the receptacle 14 and hence prevents shaking between the inner housing 23 and the receptacle 14.

The front shake preventing ribs 37 at the front of the inner housing 23 are pressed in close contact with the projections 17 of the receptacle 17 to prevent shaking between the inner housing 23 and the receptacle 14. The front shake preventing ribs could be formed, for example, on a front holder, a front retainer or the like separate from the inner housing. However, such an arrangement could result in shaking between the separate part and the inner housing and could cause abrasion of the contact parts of the terminals. However, in this embodiment, abrasion of the terminals 11, 21 is prevented reliably, since the shaking of the inner housing 23 accommodating the female terminals 21 is prevented directly without a separate part.

As described above, shaking of the male housing 12 and the inner housing 23 is prevented at positions spread over substantially the entire periphery of the inner housing 23 at both front and rear ends of the inner housing 23 and at both front and rear ends of connected parts of the terminals 11, 21 when the connectors 10, 20 are connected properly. If shaking was prevented, for example, not over the entire periphery of the inner housing, but only at the opposite sides and the lower side, then vertical shaking is permitted more or less. However, in this embodiment, shaking is prevented at positions spread over the entire periphery of the inner housing 23. Therefore the function of preventing the shaking between the two connectors 10, 20 is improved.

Abrasion of the terminals 11, 21 is prevented even if the two connectors 10, 20 are subjected to strong vibration since shaking is prevented at both front and rear ends of the inner housing 23.

The resilient member 45 presses the inner housing 23 forward and against the terminal holding portion 13 to prevent shaking, and also presses the outer housing 38 backward in the engaging direction of the lock arm 41 with the lock 15 to prevent shaking in forward and backward directions at the locked part. Further, the guide ribs 16 of the receptacle 14 press the outer shake preventing ribs 44 of the guide grooves 42 of the outer housing 38 to prevent shaking of the receptacle 14 and the outer housing 38. In this way, shaking of the connectors 10, 20 is prevented reliably and high vibration can be withstood.

In addition, the resilient member 45 expands along the surfaces of the wall 31 and the back wall 38A when pressed between the inner and outer housings 23 and 38. Thus, contact pressure on the wall 31 and the back wall 38A are distributed and become smaller. In the case of using a metallic spring or the like, the area of the contact part does not expand like e.g. rubber and contact pressure concentrates on one point without being distributed. Thus, the wall 31 and the back wall 38A would need to be thickened as an anti-creep measure. However, the connector need not be enlarged in the present application since such a measure need not be taken.

As described above, according to the first embodiment, shaking between the inner housing 23 and the male housing 12 is prevented at both front and rear ends of the inner housing 23 and at positions distributed over substantially the entire periphery of the inner housing 23 when the two connectors 10, 20 are connected properly. Thus, the function of preventing the shaking of the connectors 10, 20 is improved remarkably.

A connector assembly according to a second embodiment of the invention is described with reference to FIGS. 5 to 8.

The connector assembly of this embodiment differs from the first embodiment in that the resilient member 50, the inner housing 23 and the outer housing 38 include positioning portions in the form of recesses and projections that are engageable with each other. It should be noted that elements of the second embodiment that are identical or similar to the first embodiment are identified by the same reference numeral, but are not described again.

Figure 7:
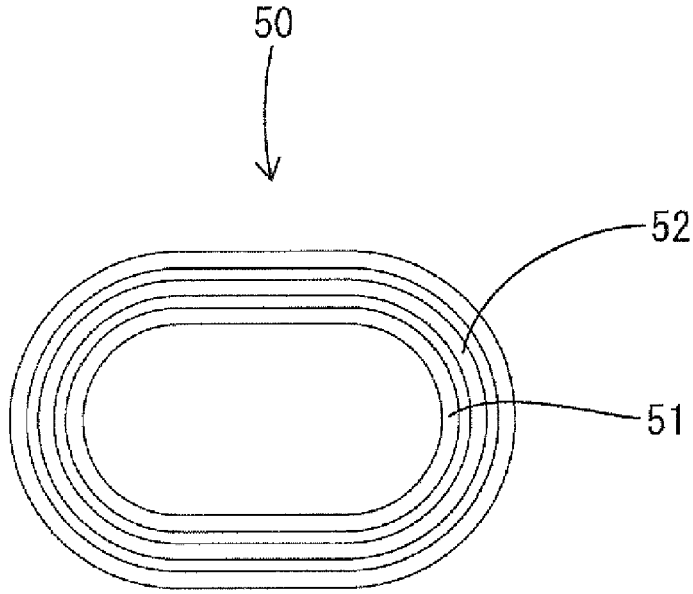
FIG. 7 is a front view of the resilient member.
Figure 8:
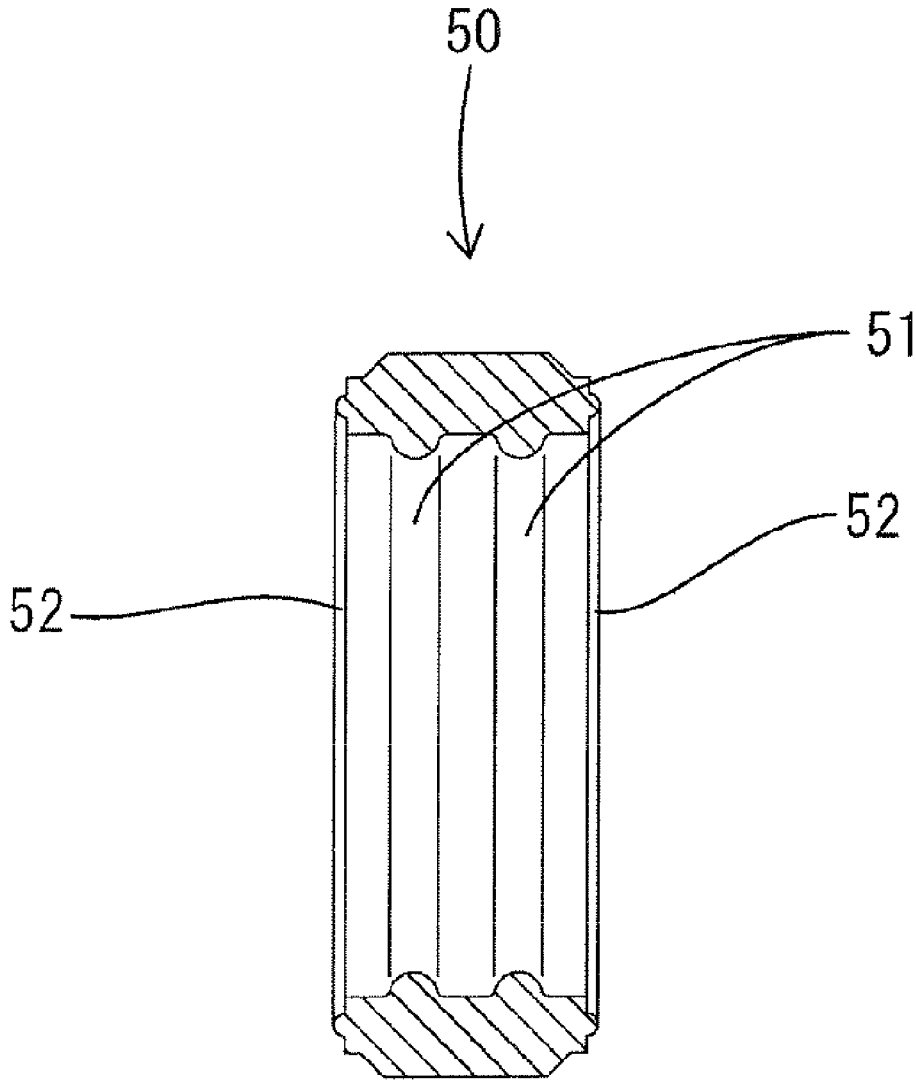
FIG. 8 is a section of the resilient member.

The resilient member 50 preferably is made of rubber and is substantially in the form of a wide tube that fits on the terminal inserting portions 23A as in the first embodiment (see FIG. 7). The resilient member 50 is shaped so that an intermediate part in forward and backward directions bulges radially out, and two lips 51 are formed on the inner peripheral surface thereof.

Positioning projections 52 are provided at both front and rear ends of the resilient member 50. The positioning projections 52 are in the form of rings formed at radially intermediate positions of the front and rear end surfaces of the resilient member 50, and project substantially forward from the front end surface and backward from the rear end surface.

The inner and outer housings 23 and 38 have positioning recesses 53 that engage the respective positioning projections 52 of the resilient member 50. The positioning recesses 53 in the rear surface of the wall 31 of the inner housing 23 are ring-shaped and surround the terminal inserting portions 23A over the entire circumference, whereas those in the front surface of the back wall 38A of the outer housing 38 are ring-shaped and surround the loose insertion holes 39 over the entire circumference. The positioning recesses 53 are shaped identically and face each other in forward and backward directions.

Figure 5:
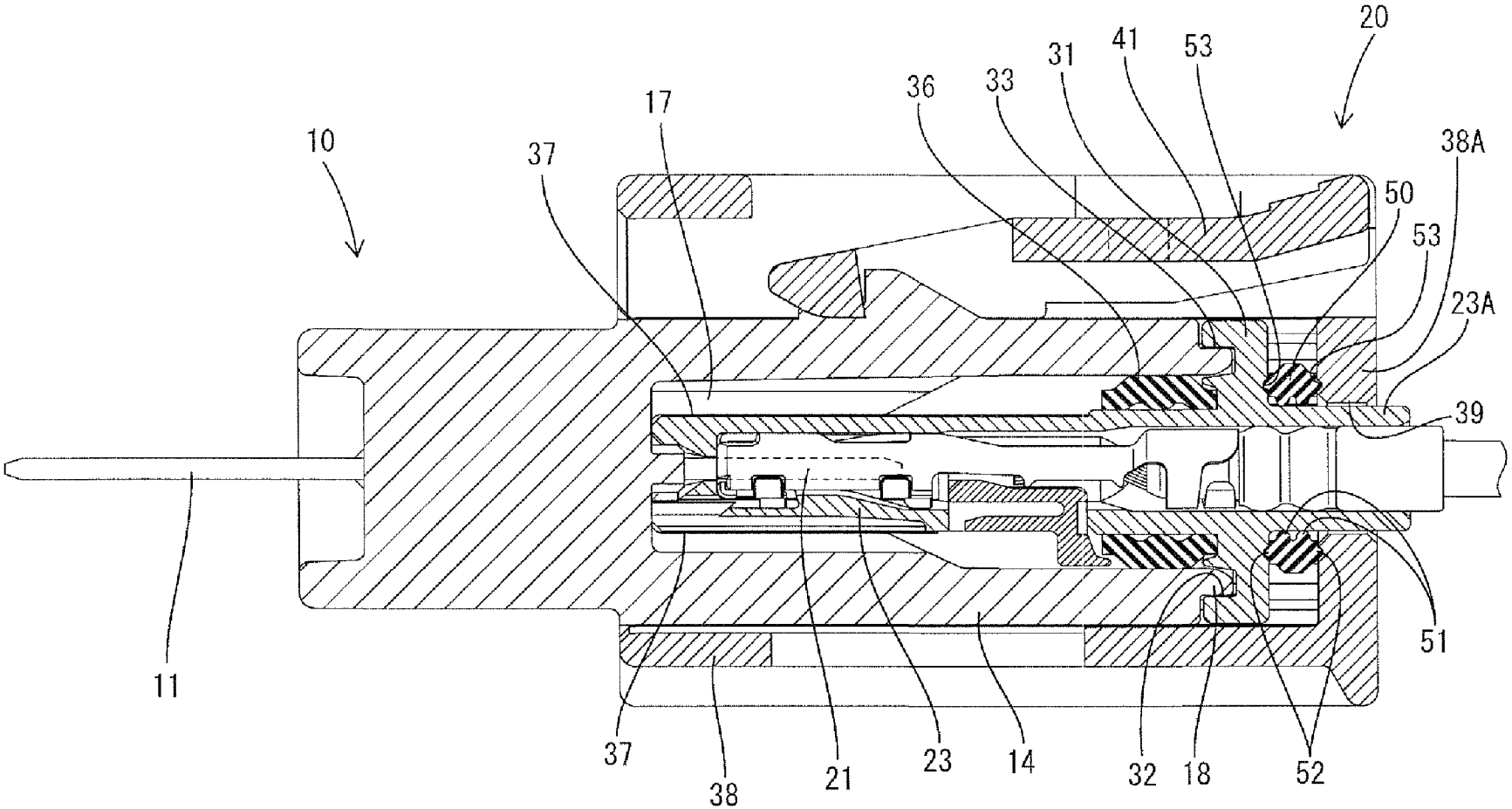
FIG. 5 is a side view in section of a connector device according to a second embodiment.
Figure 6:
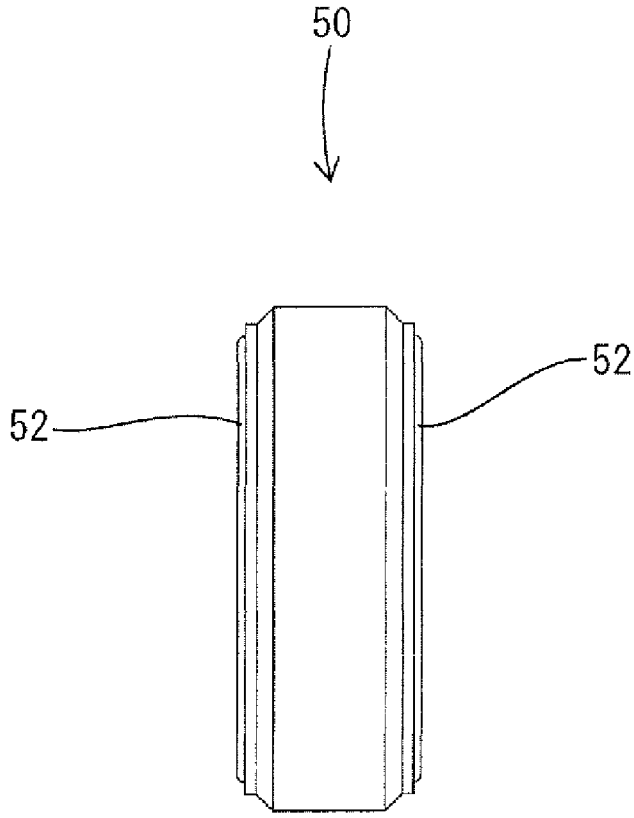
FIG. 6 is a side view of a resilient member.

As shown in FIG. 5, the resilient member 50 is mounted with the positioning projections 52 respectively engaged with the positioning recesses 53 of the inner and outer housings 23 and 38. The engagement of the positioning projections 52 and the positioning recesses 53 prevents the resilient member 50 from being displaced in directions substantially along the surfaces of the wall 31 and the back wall 38A even if squeezed between the inner housing 23 and the outer housing 38. Thus, a resilient force from the resilient member 50 acts substantially uniformly on the inner and outer housings 23 and 38 to prevent shaking of the two connectors 10, 20.

The invention is not limited to the above described and illustrated embodiments. For example, the following embodiments are also embraced by the technical scope of the present invention as defined by the claims.

The annular rib 18 and the annular groove 32 are ring-shaped to surround the inner housing 23 over substantially the entire periphery in the above embodiments. However, the invention is not limited thereto. As long as they are provided at positions to at least partly surround the inner housing 23 over the substantially entire circumference, they may not be ring-shaped. For example, they may e.g. be ribs and grooves intermittently formed at the upper, lower, left and right sides of the inner housing.

The receptacle 14 has the annular rib 18 and the wall 31 has the annular groove 32 in the above embodiments. However, the receptacle may have an annular groove and the wall may have an annular rib.

Although the projections 33 are formed in the annular groove 32 in the above embodiments, they may not be necessarily formed or they may be formed, for example, on the annular rib.

Although the front shake preventing ribs 37 are in contact with the projections 17 in the receptacle 14 in the above embodiments, the invention is not limited thereto and they may directly contact, for example, the flat inner peripheral surface of the receptacle.

The outer housing 38 is separate from the inner housing 23 in the above embodiments. However, both housings may be integral or unitary.

Although the front shake preventing ribs 37 are formed on the inner housing 23 in the above embodiments, they may be formed in the receptacle.

The outer shake preventing ribs 44 are formed in the guide grooves 42 in the above embodiments. However, they may not be necessarily formed or they may be formed, for example, on the guide ribs or parts of the outer tube other than the guide grooves.

Although the resilient member 45 (50) is made of rubber in the above embodiments, it may not be made of rubber provided that it can resiliently contract. It may be, for example, a metallic spring.

Although the seal ring 36 is mounted between the receptacle 14 and the inner housing 23 in the above embodiments, it may not necessarily be mounted.

The resilient member 50 is formed with the positioning projections 52 and the inner and outer housings 23 and 38 are formed with the positioning recesses 53 in the second embodiment. However, the resilient member may be formed with positioning recesses and the inner and outer housings may be formed with positioning projections.

What is claimed is:

1. A connector assembly, comprising:

a first connector with a forwardly open receptacle and a first terminal projecting into the receptacle;

a second connector with a housing configured for fitting into the receptacle and accommodating a second terminal connectable with the first terminal;

at least one front shake preventing rib at a position for contacting the housing or the receptacle when the connectors reach a properly connected state and preventing shaking between the connectors near a front end of the housing with respect to a connecting direction with the second connector;

at least one wall provided near a rear end of the housing with respect to the connecting direction with the first connector and arranged to substantially face an opening edge of the receptacle; and one of the opening edge of the receptacle and the wall includes at least one rear shake preventing rib projecting substantially in the connecting direction at a position around the housing, whereas the other of the opening edge of the receptacle and the wall includes at least one groove for engaging the rear shake preventing rib when the connectors reach the properly connected state for preventing shaking between the connectors.

2. The connector assembly of claim 1, wherein the front shake preventing rib is formed unitarily on a periphery of the housing.

3. The connector assembly of claim 1, wherein the second connector includes an outer housing separate from the housing and adapted to at least partly cover the housing, the outer housing includes at least one locking mechanism for locking the first connector in the connecting direction when the connectors are connected properly.

4. The connector assembly of claim 3, wherein the outer housing and the housing are slidable relative to each other in the connecting direction of the connectors, at least one resilient member being mounted between the outer housing and the housing, the resilient member being pressed by the outer housing and the housing and resiliently contracting in the connecting direction when connectors are connected properly.

5. The connector assembly of claim 4, wherein the resilient member is made of rubber.

6. The connector assembly of claim 4, wherein the resilient member, the housing and the outer housing include positioning portions in the form of projections and recesses engageable with each other.

7. The connector assembly of claim 6, wherein the positioning portions include at least one positioning projection on the resilient member and at least one positioning recess in the housing or the outer housing.

8. The connector assembly of claim 1, wherein the rear shake preventing rib and the groove are ring-shaped.

9. The connector assembly of claim 1, wherein the rear shake preventing rib is formed near the opening edge of the receptacle, and the groove is formed in the wall.

10. The connector assembly of claim 1, further comprising a projections to be pressed between the groove and the rear shake preventing rib when the connectors are connected properly.

11. The connector assembly of claim 10, wherein the projections are arranged at a position to surround the housing.

12. The connector assembly of claim 1, wherein at least one seal ring is mounted between the receptacle and the housing near an opening end of the receptacle, the sealing ring being pressed by the receptacle and the housing to provide sealing between the receptacle and the housing.

13. The connector assembly of claim 1, wherein at least one outer shake preventing rib extends between the inner peripheral surface of the outer housing and the outer peripheral surface of the receptacle for preventing the shaking between the connectors when the connectors are connected properly.

14. The connector assembly of claim 13, wherein at least one projection projects inwardly on a part of the inner peripheral surface of the receptacle corresponding to the front shake preventing rib, and the front shake preventing rib contacts the projecting end of the projection.

15. A connector assembly, comprising:

a first connector with opposite front and rear ends, a forwardly open receptacle at the front end of the first connector, a forwardly facing first shake preventing structure at the front end of the first connector and substantially surrounding the receptacle; and a second connector with an inner housing having opposite front and rear ends and an outer periphery, portions of the outer periphery adjacent the front end of the inner housing being configured for fitting into the receptacle, front shake preventing ribs at a plurality of spaced apart positions around the outer periphery of the inner housing and substantially adjacent the front end of the inner housing for contacting the receptacle when the connectors reach a properly connected state and preventing shaking between the connectors near the front end of the inner housing, a wall near the rear end of the inner housing, a forwardly facing second shake preventing structure on the wall engaging the first shake preventing structure when the connectors reach are connected properly for preventing shaking of the connectors.

16. The connector assembly of claim 15, wherein the first shake preventing structure is an annular rib and the second shake preventing structure is an annular groove.

17. The connector assembly of claim 16, wherein the second connector further has an outer housing covering at least part of the inner housing, the outer housing includes a locking mechanism for locking the first connector in the connecting direction when the connectors are connected properly.

18. The connector assembly of claim 17, wherein the outer housing and the inner housing are slidable relative to each other in a connecting direction of the connectors, a resilient member being mounted between the inner and outer housings, the resilient member being pressed by the inner and outer housing and resiliently contracting in the connecting direction when connectors are connected properly.

19. The connector assembly of claim 16, further comprising a projections in the groove for engaging the annular rib when the connectors are connected properly.

* * * * *